US006299101B1

(12) United States Patent
Schroppel et al.

(10) Patent No.: US 6,299,101 B1
(45) Date of Patent: Oct. 9, 2001

(54) ADJUSTING APPARATUS FOR CONTROL SURFACES OF A MISSILE

(75) Inventors: Werner Schroppel, Wendelstein; Josef Dommer, Nurnberg, both of (DE)

(73) Assignee: Diehl Munitionssysteme GmbH & Co., KG, Röthenbach (DE)

( * ) Notice: Subject to any disclaimer, the term of this patent is extended or adjusted under 35 U.S.C. 154(b) by 0 days.

(21) Appl. No.: 09/542,326

(22) Filed: Apr. 4, 2000

(30) Foreign Application Priority Data

May 18, 1999 (DE) ..... 199 22 693

(51) Int. Cl.[7] ..... B64C 5/12

(52) U.S. Cl. ..... 244/3.21; 244/3.27; 244/49; 244/75 R

(58) Field of Search ..... 244/75 R, 213–216, 244/3.21, 3.24–3.29; 310/67 R

(56) References Cited

U.S. PATENT DOCUMENTS 3,154,015 * 10/1964 Muller ..... 244/3.21
4,037,806 * 7/1977 Hirsch et al. ..... 244/3.28
4,438,893 * 3/1984 Sands et al. ..... 244/3.21
5,393,011 * 2/1995 Dunn et al. ..... 244/3.21
5,467,940 * 11/1995 Steuer ..... 244/3.24
5,528,092 * 6/1996 Ohta ..... 310/67 R
5,593,109 * 1/1997 Williams ..... 244/3.28
6,073,880 * 6/2000 Voigt et al. ..... 244/3.28

FOREIGN PATENT DOCUMENTS 34 41 534 A1 5/1986 (DE) .
34 41 533 C2 7/1989 (DE) .
43 35 785 A1 4/1995 (DE) .
36 13 539 C1 5/1997 (DE) .

* cited by examiner

*Primary Examiner*—Galen L. Barefoot
(74) *Attorney, Agent, or Firm*—Scully, Scott, Murphy & Presser

(57) ABSTRACT

In an adjusting apparatus for control surfaces of a missile the control surfaces 2, 3 are displaceable by adjusting motors 5, 6 by way of thrust spindles 15. To afford a compact structure and a low weight the stators 7 of the adjusting motors 5, 6 are arranged directly in a carrier housing 4 and the thrust spindle 15 engages into a female thread 14 of the motor shaft 9.

10 Claims, 4 Drawing Sheets

F
24
10
1
23
8
5
9
7
14,16
12
11
10
15
11
4
21
17
18
B
B
3
A
2
20
19
B
A
3 r1
9
8
5
7
23
14,16
15
t
22
21
17
B
18
r2
19
20

ADJUSTING APPARATUS FOR CONTROL SURFACES OF A MISSILE

BACKGROUND OF THE INVENTION

1. Field of the Invention

The invention concerns an adjusting apparatus for control surfaces of a missile, wherein the control surfaces are displaceable by adjusting motors by way of thrust spindles and the adjusting motors are disposed in a carrier housing arranged in the missile tail.

2. Discussion of the Prior Art

An adjusting apparatus of that kind is described in DE 43 35 785 A1. In that case the adjusting motors are provided with their own housings and are supported in swinging or oscillating relationship on the carrier housing. That structure requires a comparatively large amount of space.

A further adjusting apparatus for control fins or rudders of a steerable missile is described in DE 34 41 533 C2. That arrangement involves an advantageous coupling device between the control fin and a linear adjusting member. The coupling device can be pre-set by means of a setting device.

A support arrangement for the pivotable rudder blade of a steerable missile, in particular a missile which can be fired by means of propellent charge gas pressure, is known from DE 34 41 534 A1.

SUMMARY OF THE INVENTION

The object of the present invention is to propose an adjusting apparatus of the kind set forth in the opening part of this specification, of a particularly compact structure.

In accordance with the invention the foregoing object is attained in that the stators of the motors are arranged directly in the carrier housing and that the thrust spindle engages into a female screwthread of the motor shaft.

As the stators of the adjusting motors are installed in the carrier housing itself, there is no need for specific motor housings, and that signifies a saving in space and a reduction in weight. Two adjusting motors with parallel axes can be installed in mutually juxtaposed relationship even in a constricted missile tail There is therefore no need for the adjusting motors to be arranged in the tail in staggered relationship in the longitudinal direction, which would increase the structural length involved. The one adjusting motor serves to displace one pair of control surfaces and the other adjusting motor serves to displace the other pair.

A short structural length is also made possible because the thrust spindles engage into female screwthreads of the motor shafts. The compact structure involved here is linked to a reduction in weight. The extremely compact and light adjusting apparatus is suitable in particular for a projectile which can be fired by a propellent charge (mortar projectile) and which has control fins or rudders.

A short structural length for the adjusting apparatus is further encouraged by the fact that the female screwthread into which the thrust spindle engages is disposed within a rolling bearing supporting the motor shaft.

In an embodiment of the invention the carrier housing is so designed that, arranged in the tail region, it supports the tail region of the missile in relation to radial forces, in particular gas pressure forces. As a result a reduced wall thickness for the tail region is sufficient, thereby making it possible to save weight and to afford an installation space of increased internal diameter.

In order to make the adjusting apparatus particularly capable of withstanding acceleration, the inner race and the outer race of a rolling bearing supporting the motor shaft are supported in the carrier housing in the event of launch acceleration of the missile. Preferably a disc is provided for that purpose in the carrier housing.

The adjusting apparatus is also immune to acceleration phenomena by virtue of the fact that the motor is a brush-less motor.

BRIEF DESCRIPTION OF THE DRAWINGS

Further advantageous configurations of the invention are set forth in the description hereinafter of an embodiment. In the drawing.

DETAILED DESCRIPTION OF PREFERRED EMBODIMENTS

Figure 1:
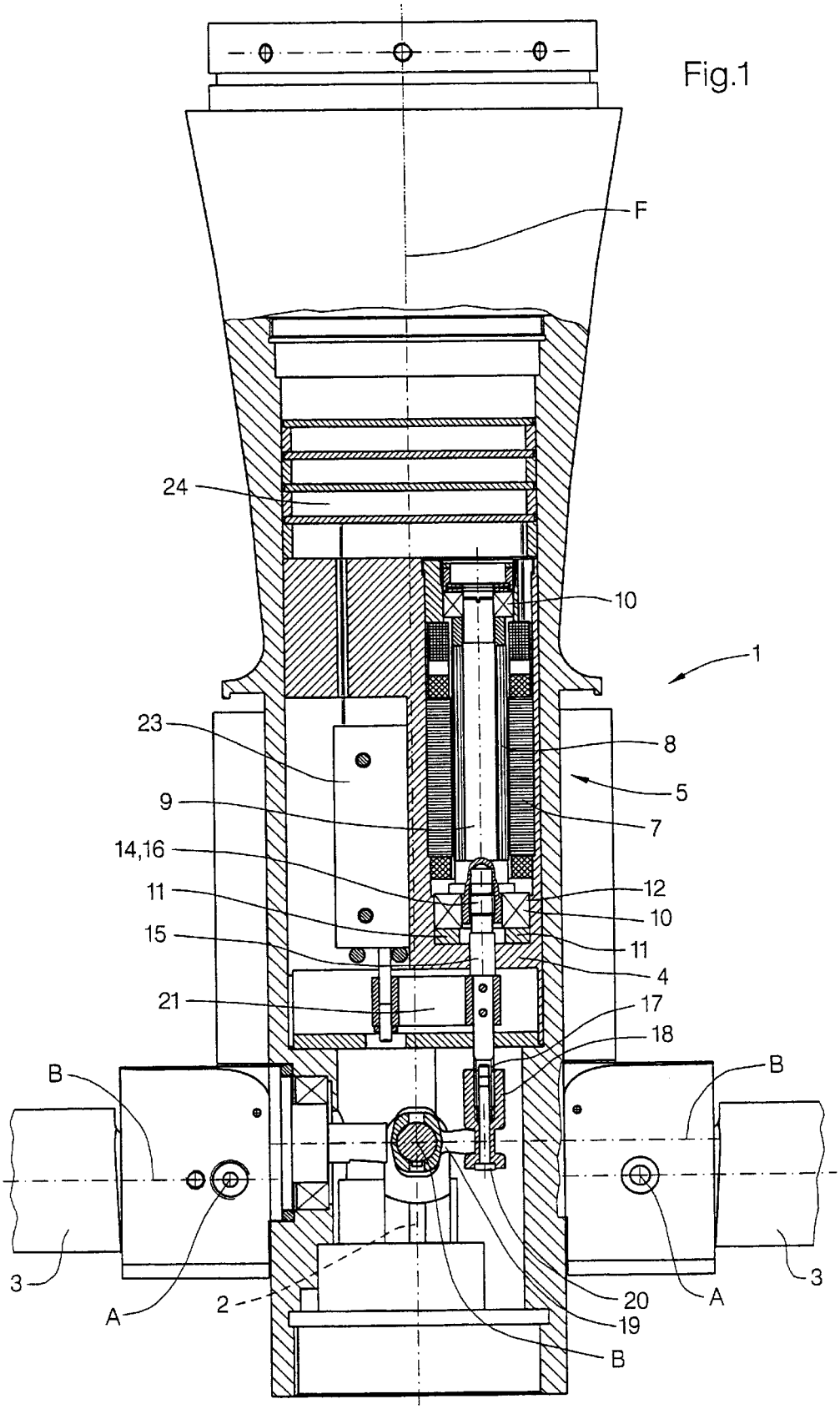
FIG. 1 is a view in longitudinal section of an adjusting apparatus in the tail of a missile.
Figure 4:
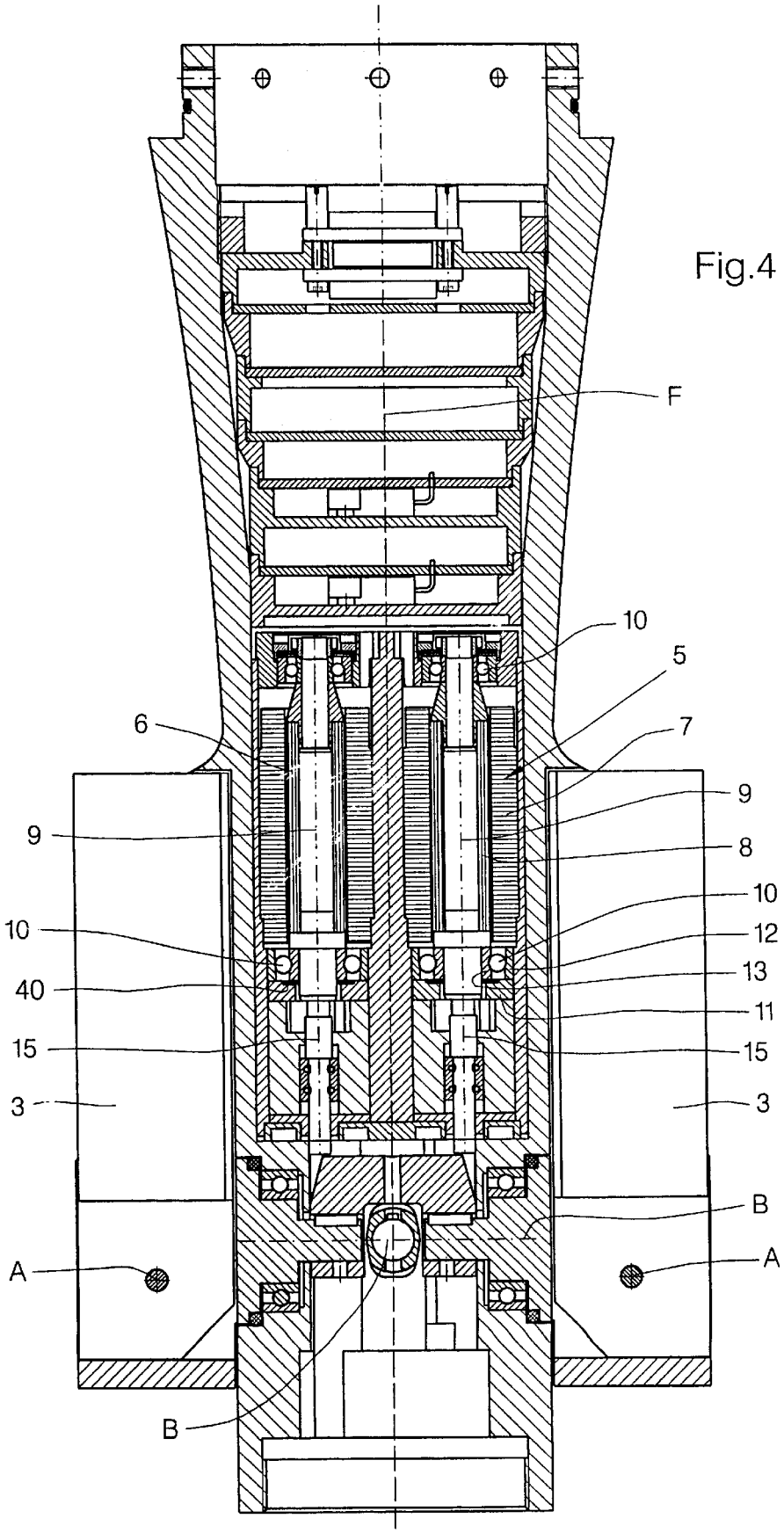
FIG. 4 is a further view in longitudinal section.

A missile or projectile which can be fired by means of a propellent charge (mortar projectile) carries in the tail region 1 a pair of control surfaces with control surfaces 2 and a pair of control surfaces with control surfaces 3. The control surfaces 2, 3 can be pivoted out about the axes A (compare FIG. 4 with FIG. 1) and are pivotable about control surface axes B by means of an adjusting apparatus.

Figure 3:
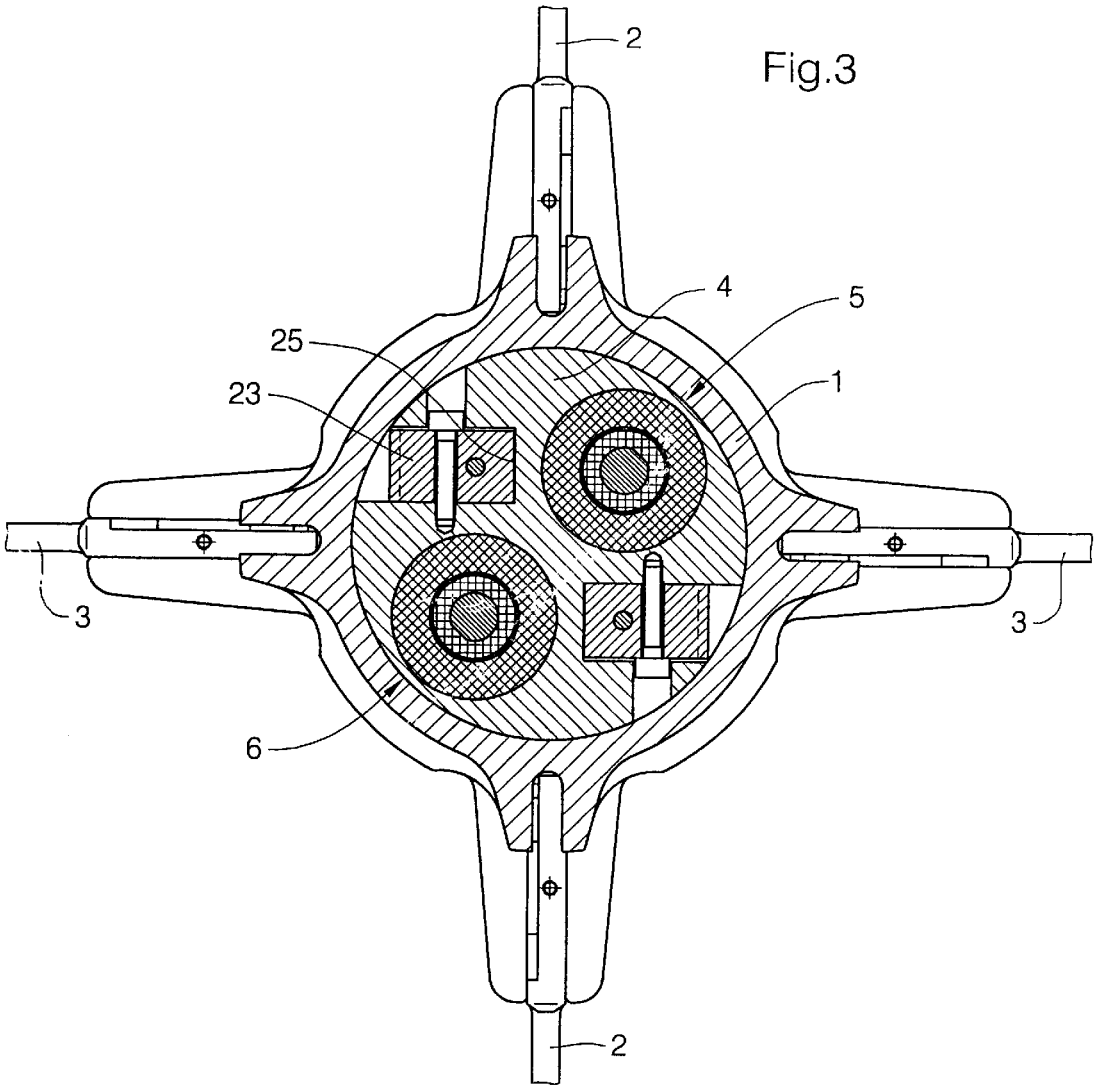
FIG. 3 is a view in cross-section of the adjusting apparatus.

The adjusting apparatus has a carrier housing 4 which is fitted into the tail region 1. The carrier housing 4 which is stable in respect of shape supports the tail region 1 radially with respect to the longitudinal axis F of the projectile or missile and in that respect carries radial pressure forces which occur upon launch so that, where the tail region 1 is supported by the carrier housing 4, the wall thickness of the tail region 1 can be smaller than elsewhere. That increases the usable structural space in the interior of the tail region 1. Provided in the carrier housing 4 are an adjusting motor 5 for displacing the one pair of control surfaces and an adjusting motor 6 for displacing the other pair of control surfaces. The motors 5, 6 are disposed in mutually juxtaposed relationship (see FIGS. 3 and 4). Their motor shafts extend parallel to each other. The two motors 5, 6 are of the same structure and are connected to the associated pair of control surfaces in the same manner. Hereinafter, for the sake of simplification, only the one motor and its coupling to its pair of control surfaces will be described. The description applies in corresponding manner to the other motor.

The motor is brush-less and housing-less. Its stator 7 is fitted directly into the carrier housing 4, for example being secured therein by adhesive. Its rotor 8 is carried on the motor shaft 9.

The motor shaft 9 is supported at both ends by means of ball bearings 10 which are fitted into the carrier housing 4, for example angular-contact ball bearings. In order to ensure that the axial forces which occur upon launch acceleration do not damage and destroy the load-bearing rolling bearing, a disc 11 is provided at the tail-end rolling bearing 10. The outer race 12 of the rolling bearing 10 bears against the disc 11. In the region of the inner race 13 the disc 11 has a step 40 with play between the inner race 13 and the outer race 12, such play being accurately defined in regard to the rolling bearing 10. Upon launch acceleration, before the axial force which is permissible for the rolling bearing 10 is exceeded, the inner race 13 of the rolling bearing 10 bears against the disc 11 on which the outer race 12 is supported. In that way the axial force acting on the rolling bearing 10 is limited in such a fashion that the rolling bearing 10 is not destroyed. After launch, the inner race 13 of the bearing which is elastically deformed by the launch acceleration effect is detached again from the disc 11 so that the inner race 13 is free.

Within the tail-end rolling bearing 10 the motor shaft 9 has a female screwthread 14 into which engages a thrust spindle 15 with a male screwthread 16, the thrust spindle 15 being axially movable and being prevented from rotating. By virtue of the screwthreaded engagement being within the rolling bearing 10, the arrangement enjoys a short structural length. Carried at the other end of the thrust spindle 15 at a male screwthread 17 is an engagement nut 18 which is coupled to an entrainment lever 19 fixed to the shaft B of the one pair of control surfaces. The position of the shaft B of the control surfaces on the thrust spindle 15 can be adjusted by rotating the engagement nut 18. The adjusted position can be fixed by means of a lock screw 20.

Figure 2:
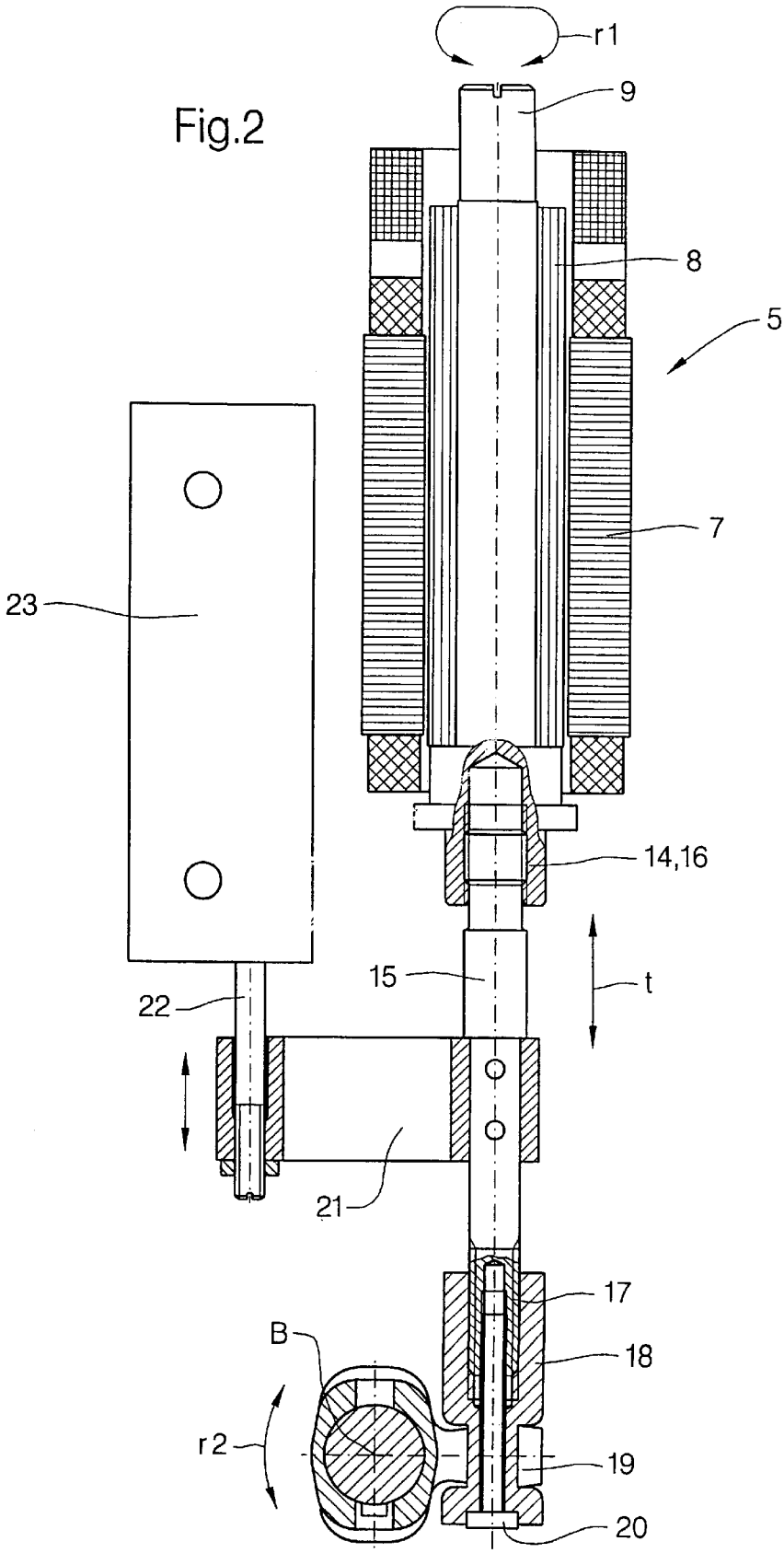
FIG. 2 is a diagrammatic view of the transmission train of the adjusting apparatus.

Conversion of the rotary movement of the rotor 8 into the pivotal movement of the control surface shaft B takes place in the following manner:

By virtue of rotational movement r1 (see FIG. 2) of the motor shaft 9, the thrust spindle 15 is moved with a translatory movement in the direction t by way of the co-operating threads 14, 16. As a result, the control surface shaft B is moved with a rotational movement indicated at r2 (see FIG. 2) by way of the entrainment lever 19. The radial reaction forces which occur when the movements are converted in the above-indicated manner are carried by the rolling bearings 10. In that case, only a low level of friction occurs, which enhances the level of efficiency of the transmission train. The low weight and the low moment of inertia of the movable parts permits a high level of dynamics (band width) of the movement. The transmission train permits a high transmission ratio in a very small space. There is no need for a ball screw transmission between the motor shaft 9 and the thrust spindle 15. A metric thread is sufficient.

The indicated adjusting apparatus is of a compact structure and comparatively light. A small number of movable parts are sufficient to provide an easily movable transmission train.

Fixed to the thrust spindle 15 is an arm 21 which engages an adjusting member 22 of a linear potentiometer 23. The linear potentiometer 23 is connected to an electronic regulating system arranged in the space 24. The linear potentiometer 23 is arranged in an opening 25 (see FIG. 3) in the carrier housing 4. The actual position of the respective pair of control surfaces is signaled to the electronic regulating system by way of the linear potentiometer 23. Instead of the linear potentiometer, it is also possible to adopt other measures for detecting the actual position of the control surfaces.

What is claimed is:

1. An adjusting apparatus for control surfaces of a missile, wherein the control surfaces are displaceable by a pair of juxtaposed adjusting motors each having a motor shaft and extending in parallel with a central longitudinal axis of said missile, and being in operative engagement with thrust spindles, the adjusting motors being disposed in a carrier housing arranged in the missile tail, stators (7) of the adjusting motors (5,6) being arranged directly in the carrier housing (4) and wherein each said thrust spindle (15) engages into a female thread (14) of a therewith associated one of said motor shafts (9).

2. An adjusting apparatus according to claim 1 characterized in that the female thread (14) into which the thrust spindle (15) engages is disposed within a rolling bearing (10) which supports the motor shaft (9).

3. An adjusting apparatus according to claim 2 characterized in that the rolling bearing (10) supporting the motor shaft (9) has an inner race (13) and an outer race (12) and that the inner race (13) and the outer race (12) are supported in the carrier housing (4) upon launch acceleration on the part of the missile.

4. An adjusting apparatus according to claim 3 characterized in that a disc (11) is arranged in the carrier housing (4), the outer race (12) and upon launch acceleration also the inner race (13) being supported against the disc (11).

5. An adjusting apparatus according to claim 2 characterized in that the rolling bearing (10) is an angular-contact ball bearing.

6. An adjusting apparatus according to claim 1 characterized in that the motor shafts (9) are disposed in the carrier housing (4) in mutually parallel and juxtaposed relationship.

7. An adjusting apparatus according to claim 1 characterized in that the adjusting motors are brush-less motors.

8. An adjusting apparatus according to claim 1 characterized in that the carrier housing (4) supports the tail region (1) of the missile in relation to radial forces.

9. An adjusting apparatus according to claim 1 characterized in that the position of the control surfaces is adjustable in relation to the thrust spindle (15).

10. An adjusting apparatus according to claim 1 characterized in that there is provided a potentiometer (23) for signalling the control surface position to an electronic control system and that an adjusting member (22) of the potentiometer (23) is connected to the thrust spindle (15).

* * * * *